US011738424B2

(12) United States Patent
Johnson

(10) Patent No.: US 11,738,424 B2
(45) Date of Patent: Aug. 29, 2023

(54) PORTABLE DRYWALL SANDER HUB ASSEMBLIES WITH APERTURED BACKING ASSEMBLIES

(71) Applicant: Abrasive Solutions of the Carolinas, LLC, Rock Hill, SC (US)

(72) Inventor: William Daniel Johnson, Rock Hill, SC (US)

(73) Assignee: ABRASIVE SOLUTIONS OF THE CAROLINAS, LLC, Rock Hill, SC (US)

( * ) Notice: Subject to any disclaimer, the term of this patent is extended or adjusted under 35 U.S.C. 154(b) by 291 days.

(21) Appl. No.: 17/038,892

(22) Filed: Sep. 30, 2020

(65) Prior Publication Data

US 2022/0097209 A1 Mar. 31, 2022

(51) Int. Cl.
*B24D 9/08* (2006.01)
*B24B 23/02* (2006.01)

(52) U.S. Cl.
CPC ..... *B24D 9/085* (2013.01); *B24B 23/02* (2013.01); *B24D 2201/00* (2013.01)

(58) Field of Classification Search
CPC ..... B24B 23/02; B24B 23/04; B24B 23/046; B24B 7/18; B24B 7/182; B24B 7/186; B24B 55/06; B24B 55/10; B24B 55/102; B24D 9/085; B24D 9/08; B24D 9/10; B24D 2201/00; B24D 7/10
See application file for complete search history.

(56) References Cited

U.S. PATENT DOCUMENTS 4,287,685 A * 9/1981 Marton ..... B24B 55/102 451/514
5,626,510 A * 5/1997 Bergner ..... B24B 23/04 451/344
2020/0338686 A1* 10/2020 Sun ..... B24B 23/028
2021/0122000 A1* 4/2021 Droste ..... B24B 55/052

FOREIGN PATENT DOCUMENTS

WO WO-2007143400 A2 * 12/2007 ..... B24B 55/102

* cited by examiner

*Primary Examiner* — Brian D Keller
*Assistant Examiner* — Robert C Moore
(74) *Attorney, Agent, or Firm* — Seth L. Hudson; Maynard Nexsen PC

(57) ABSTRACT

A backerplate for a portable drywall sander hub assembly includes a mounting portion and a backerplate body. The mounting portion includes a threaded bore adapted to couple the backerplate to a sander hub. The backerplate body is connected to the mounting portion. The backerplate body forms a plurality of apertures therein positioned radially between an outer circumference of the backerplate body and the mounting portion. The plurality of apertures are adapted for dust to pass therethrough during operation of a drywall sander with the backerplate mounted thereto.

8 Claims, 7 Drawing Sheets

PORTABLE DRYWALL SANDER HUB ASSEMBLIES WITH APERTURED BACKING ASSEMBLIES

FIELD OF THE DISCLOSURE

The present disclosure generally relates to portable drywall sander hub assemblies. More particularly, the present disclosure relates to systems and methods for portable drywall sander hub assemblies with apertured backing assemblies.

BACKGROUND OF THE DISCLOSURE

Drywall finishing requires the application of a drywall joint compound, which is used to conceal seams between drywall sheets and to conceal fasteners, such as nails, used to hang the drywall. For a smooth and uniform finish, the drywall joint compound is sanded upon drying.

The sanding process produces a significant amount of dust from the drywall joint compound and the drywall sheets. This dust permeates the construction area and causes breathing hazards for the person performing the sanding. Further, accumulation of dust between the sanding medium and the sanding surface (surfaces of the drywall sheet/drywall joint compound) can interfere with the sanding process, such as by gumming up the sanding medium, and the like.

BRIEF SUMMARY OF THE DISCLOSURE

The present disclosure generally provides a portable drywall sander hub assembly with an apertured backing assembly. The portable drywall sander hub assembly with the apertured backing assembly is adapted for dust to pass through the apertured backing assembly and into a cavity formed by the sander hub and the apertured backing assembly during operation of the drywall sander. Dust passing through the apertured backing assembly reduces an amount of dust accumulating between the sanding medium and the sanding surface and reduces the amount of dust being dispersed into the environment during the sanding process.

In one exemplary embodiment, the present disclosure provides a backerplate for a portable drywall sander hub assembly. The backerplate includes a mounting portion and a backerplate body. The mounting portion includes a threaded bore adapted to couple the backerplate to a sander hub. The backerplate body is connected to the mounting portion and forms a plurality of apertures therein positioned radially between an outer circumference of the backerplate body and the mounting portion. The plurality of apertures is adapted for dust to pass therethrough during operation of a drywall sander with the backerplate mounted thereto.

In embodiments, the mounting portion includes a rear protrusion that protrudes in an axial direction of the mounting portion and protrudes relative to the backerplate body in the axial direction. The rear protrusion is adapted to ensure that the backerplate body is offset from an opposing axially facing surface of the sander hub.

In embodiments, the mounting portion includes a front protrusion that protrudes in an axial direction of the mounting portion and protrudes relative to the backerplate body in the axial direction. The front protrusion is adapted to guide at least one of an intermediate plate and a backerplate fastener into axial alignment with the backerplate.

In embodiments, the backerplate body includes an annular disc shape and the plurality of apertures are symmetrically positioned about the annular disc shape. Optionally, the plurality of apertures includes a first set of apertures symmetrically positioned at a first radial offset about an axis of the annular disc shape and a second set of apertures symmetrically positioned at a second radial offset about the axis of the annular disc shape, the second radial offset being different than the first radial offset. And optionally, wherein the first set of apertures include a size and a spacing that is different than the second set of apertures.

In another exemplary embodiment, the present disclosure provides a backing assembly for a portable drywall sander hub assembly. The backing assembly includes a backerplate and an intermediate plate. The backerplate includes a mounting portion and a backerplate body. The mounting portion includes a threaded bore adapted to couple the backerplate to a sander hub. The backerplate body is connected to the mounting portion and forms a plurality of apertures therein positioned radially between an outer circumference of the backerplate body and the mounting portion. The plurality of apertures is adapted for dust to pass therethrough during operation of a drywall sander with the backerplate mounted thereto. The intermediate plate is joined to the backerplate. The intermediate plate includes an intermediate plate body forming a plurality of intermediate plate apertures therein. The plurality of intermediate plate apertures being sized and spaced to match and align with the plurality of backerplate apertures. The plurality of backerplate apertures and the plurality of intermediate plate apertures are adapted for dust to pass therethrough during operation of a drywall sander with the backerplate and intermediate plate mounted thereto.

In embodiments, the mounting portion includes a rear protrusion that protrudes in an axial direction of the mounting portion and protrudes relative to the backerplate body in the axial direction opposite the intermediate plate. The rear protrusion adapted to ensure that the backerplate body is offset from an opposing axially facing surface of the sander hub.

In embodiments, the mounting portion includes a front protrusion that protrudes in an axial direction of the mounting portion and protrudes relative to the backerplate body in the axial direction towards the intermediate plate. The front protrusion is adapted to guide the intermediate plate into axial alignment with the backerplate. The intermediate plate includes an intermediate plate bore adapted to receive the front protrusion.

In embodiments, the backerplate and the intermediate plate are joined by a hook and loop fastener. The hook and loop fastener includes a first fastener attached to the backerplate and a second fastener attached to the intermediate plate. Each of the first fastener and the second fastener includes a plurality of fastener apertures sized and spaced to match and align with the plurality of backerplate apertures and the plurality of intermediate plate apertures.

In embodiments, the backerplate body and the intermediate plate each comprise an annular disc shape, and wherein the plurality of backerplate apertures and the plurality of intermediate plate apertures are symmetrically positioned about the respective annular disc shape. Optionally, the plurality of backerplate apertures and the plurality of intermediate plate apertures each includes a first set of apertures symmetrically positioned at a first radial offset about an axis of the respective annular disc shape and a second set of apertures symmetrically positioned at a second radial offset about the axis of the respective annular disc shape. The second radial offset is different than the first radial offset. And optionally, the first set of apertures include a size and a spacing that is different than the second set of apertures for each of the plurality of backerplate apertures and the plurality of intermediate plate apertures.

In a further exemplary embodiment, the present disclosure provides a portable drywall sander hub assembly. The portable drywall sander hub assembly includes a sander hub and a backerplate. The sander hub forms a counterbore with an inner surface. The sander hub includes a fastener protruding within the counterbore. The backerplate is adapted to be received in the counterbore. The backerplate includes a mounting portion and a backerplate body. The mounting portion includes a threaded bore adapted to couple the fastener of the counterbore. The backerplate body is adapted to be offset from the inner surface while the mounting portion is coupled to the fastener. The backerplate is connected to the mounting portion and forms a plurality of apertures therein positioned radially between an outer circumference of the backerplate body and the mounting portion. The plurality of apertures is adapted for dust to pass therethrough and into a cavity, formed in the counterbore between the sander hub and the backerplate body, during operation of a drywall sander with the backerplate mounted thereto.

In embodiments, the mounting portion includes a rear protrusion that protrudes in an axial direction of the mounting portion and protrudes relative to the backerplate body in the axial direction. The rear protrusion is adapted to ensure that the backerplate body is offset from an opposing axially facing surface of the sander hub.

In embodiments, the backerplate body comprises an annular disc shape and the plurality of apertures are symmetrically positioned about the annular disc shape. Optionally, the plurality of apertures includes a first set of apertures symmetrically positioned at a first radial offset about an axis of the annular disc shape and a second set of apertures symmetrically positioned at a second radial offset about the axis of the annular disc shape. The second radial offset is different than the first radial offset. And optionally, the first set of apertures include a size and a spacing that is different than the second set of apertures.

In embodiments, portable drywall sander hub assembly further includes an intermediate plate joined to the backerplate. The intermediate plate including an intermediate plate body forming a plurality of intermediate plate apertures therein, the plurality of intermediate plate apertures being sized and spaced to match and align with the plurality of backerplate apertures. Optionally, the mounting portion includes a front protrusion that protrudes in an axial direction of the mounting portion and protrudes relative to the backerplate body in the axial direction towards the intermediate plate. The front protrusion is adapted to guide the intermediate plate into axial alignment with the backerplate. The intermediate plate includes an intermediate plate bore adapted to receive the front protrusion.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE DISCLOSURE

In various embodiments, the present disclosure relates to systems and methods for drywall sanding, and in particular to a portable drywall sander hub assembly with an apertured backing assembly. The sander hub and the apertured backing assembly are adapted to form a cavity, and the apertured backing assembly includes apertures therein adapted for dust to pass through the apertured backing assembly and into the cavity. By collecting dust in the cavity, the dust is drawn away from the surface of the sanding medium. By drawing dust away from the surface of the sanding medium, an amount of dust accumulating between the sanding medium and the sanding surface is reduced, reducing the possibility of dust interfering with the sanding properties of the sanding surface and reducing the amount of dust being dispersed into the environment.

Figure 1:
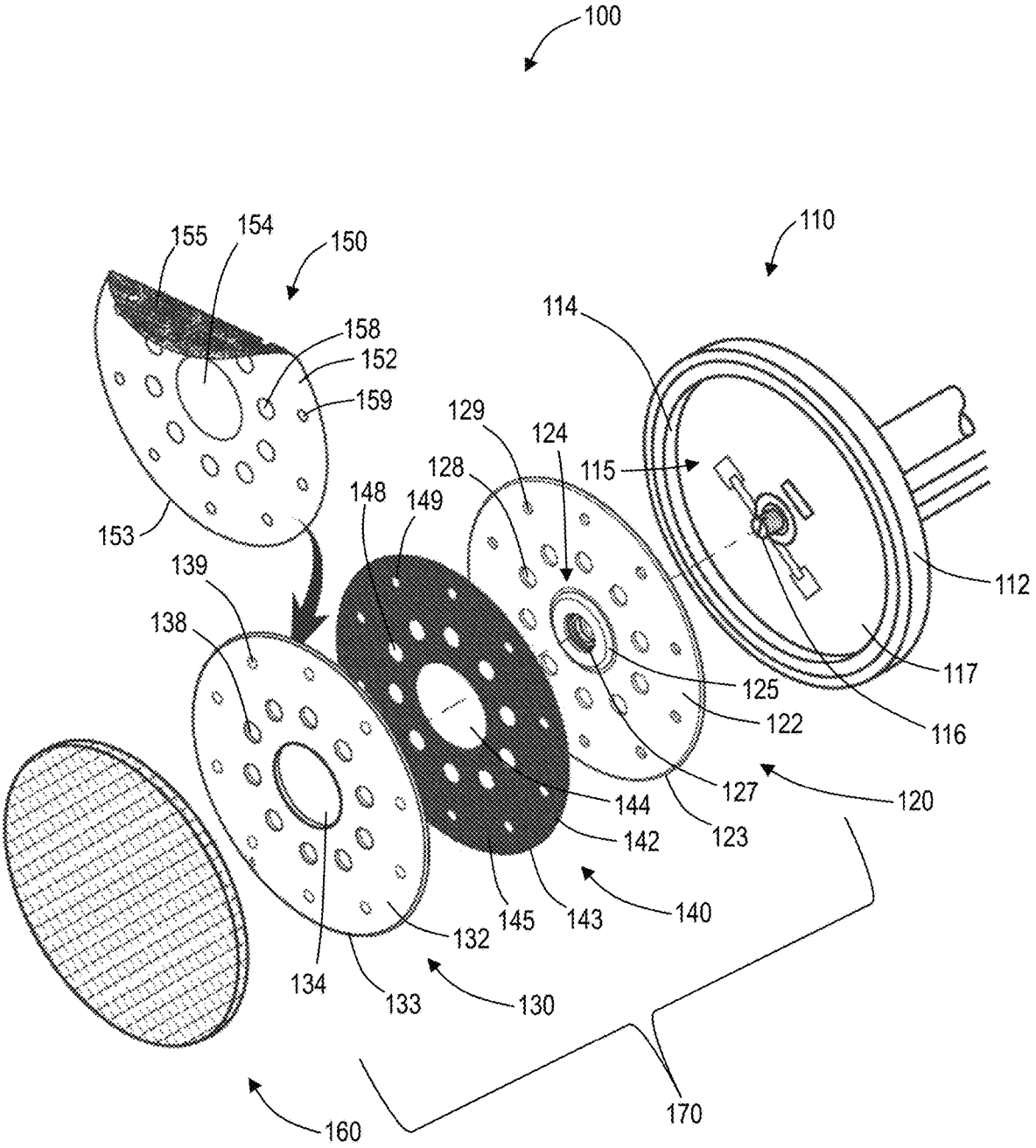
FIG. 1 is an exploded perspective view of an exemplary embodiment of a portable drywall sander hub assembly.

FIG. 1 is an exploded perspective view of an exemplary embodiment of a portable drywall sander hub assembly 100. In embodiments, the portable drywall sander hub assembly 100 includes a sander hub 110, a backing assembly 170, and a sanding medium 160, such as sanding screens, sandpaper, and the like.

Figure 2:
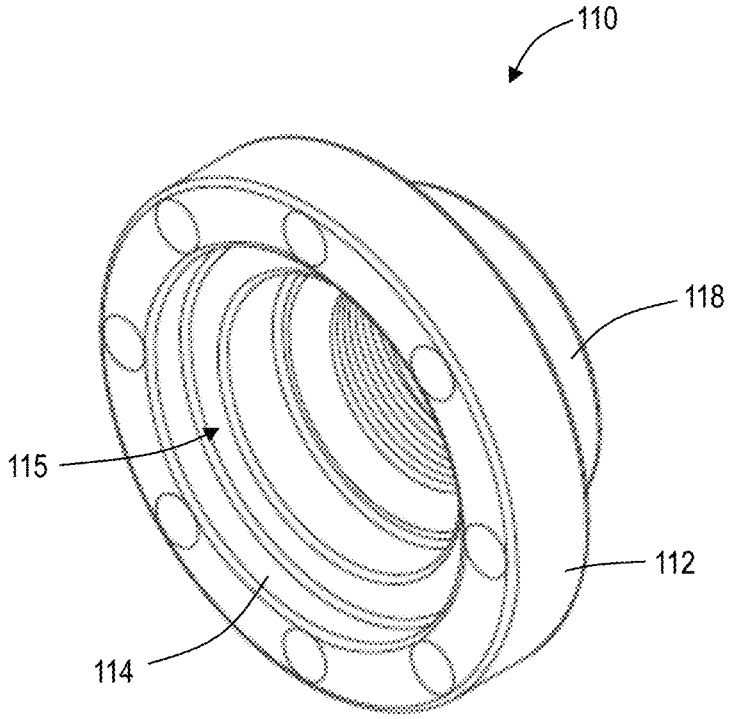
FIG. 2 is a perspective view of the sander hub of the portable drywall sander hub assembly of FIG. 1.
Figure 3:
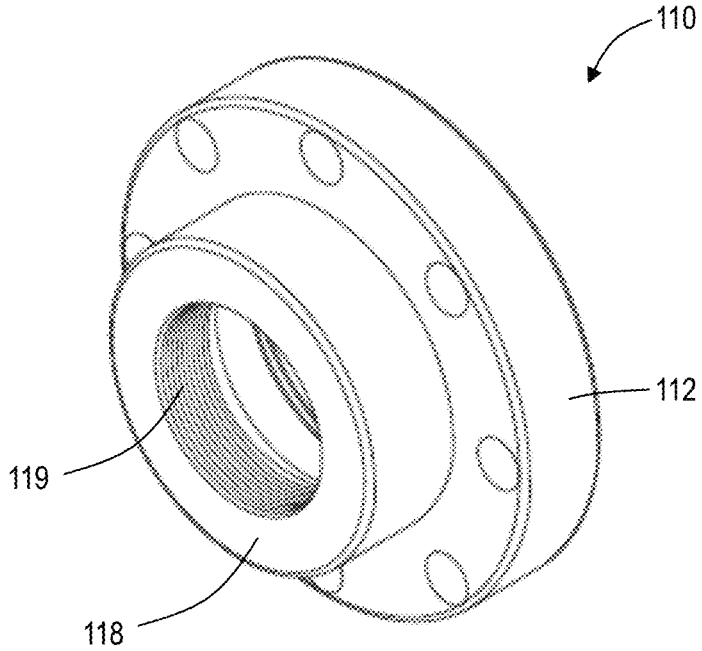
FIG. 3 is an alternate perspective view of the sander hub of FIG. 2.
Figure 4:
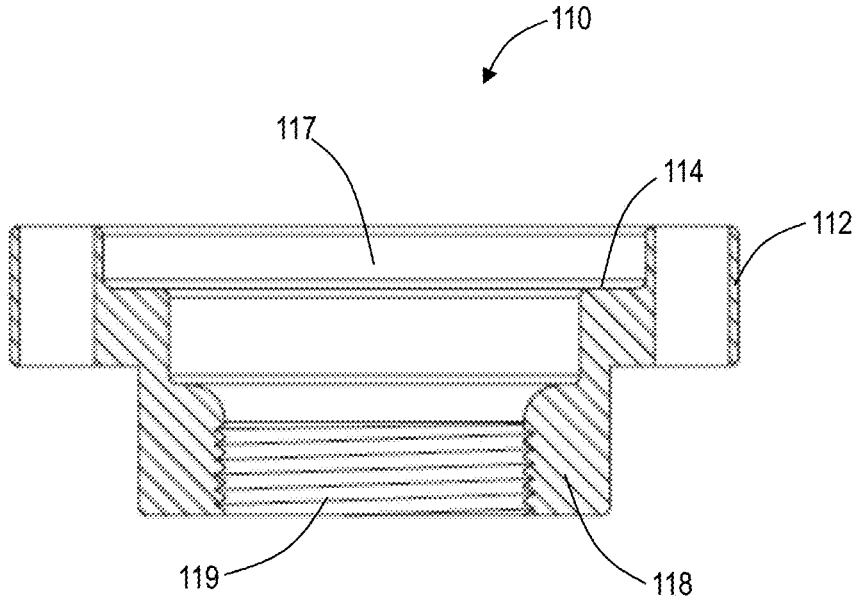
FIG. 4 is a cross-sectional view of the sander hub of FIGS. 2 and 3.

FIG. 2 is a perspective view of the sander hub of the portable drywall sander hub assembly of FIG. 1. FIG. 3 is an alternate perspective view of the sander hub 110 of FIG. 2. FIG. 4 is a cross-sectional view of the sander hub 110 of FIGS. 2 and 3. Referring to FIGS. 1-4, the sander hub 110 forms a counterbore 114 with an inner surface 115. The sander hub 110 includes a fastener 116 protruding within the counterbore 114. The sander hub 110 is adapted to form a cavity 117 within the counterbore 114 between the sander hub 110 and the backing assembly 170. The fastener 116 is adapted to interface with the backing assembly 170 such that the backing assembly 170 is offset from the inner surface 115, which forms the cavity 117.

In some embodiments, the sander hub 110 includes a flange 118 that forms a flange threaded bore 119. The flange threaded bore 119 is adapted to secure the sander hub 110 to the drywall sander.

Figure 5:
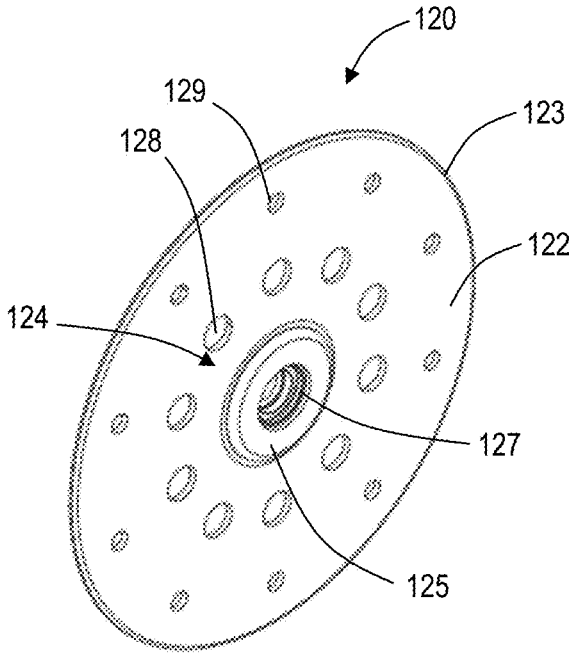
FIG. 5 is a perspective view of the backerplate of the portable drywall sander hub assembly of FIG. 1.
Figure 6:
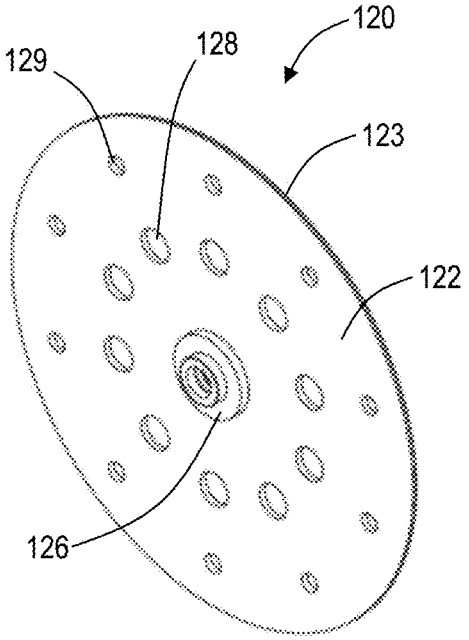
FIG. 6 is an alternate perspective view of the backerplate of FIG. 5.
Figure 7:
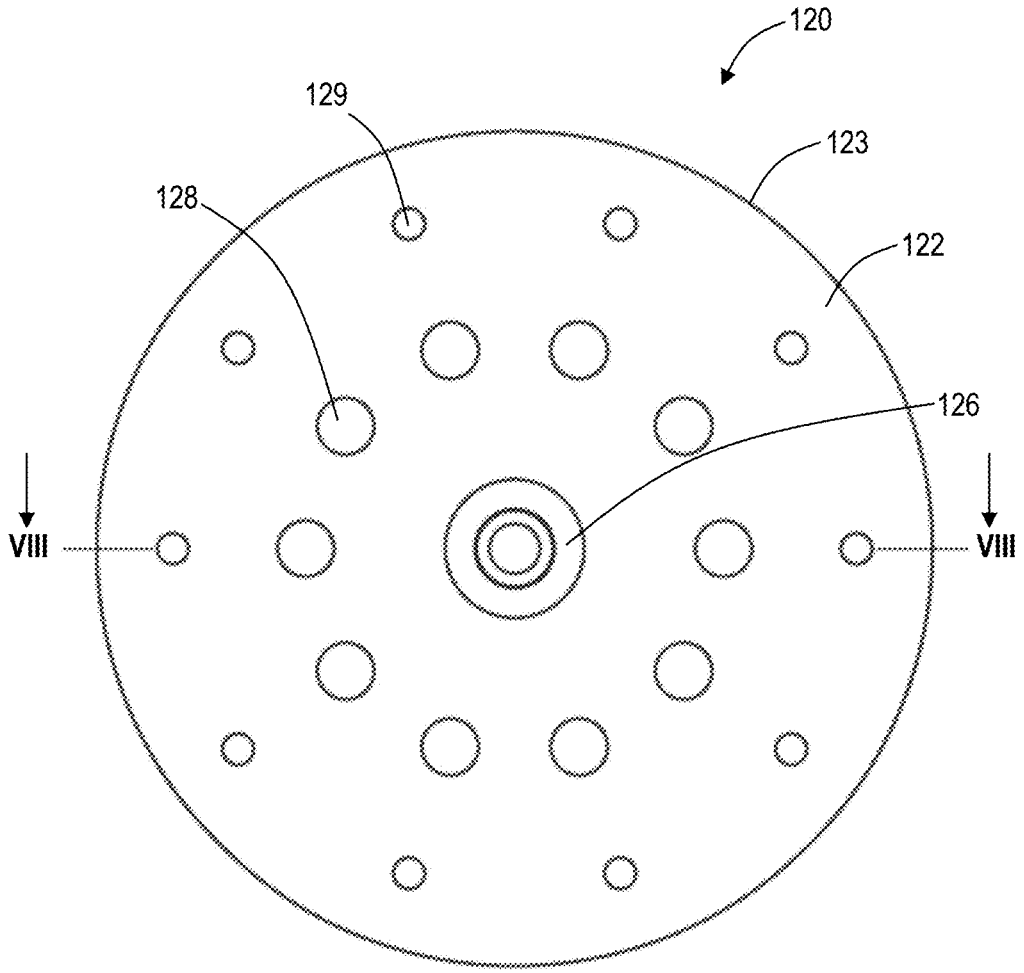
FIG. 7 is a top perspective view of the backerplate of FIGS. 5 and 6.
Figure 8:
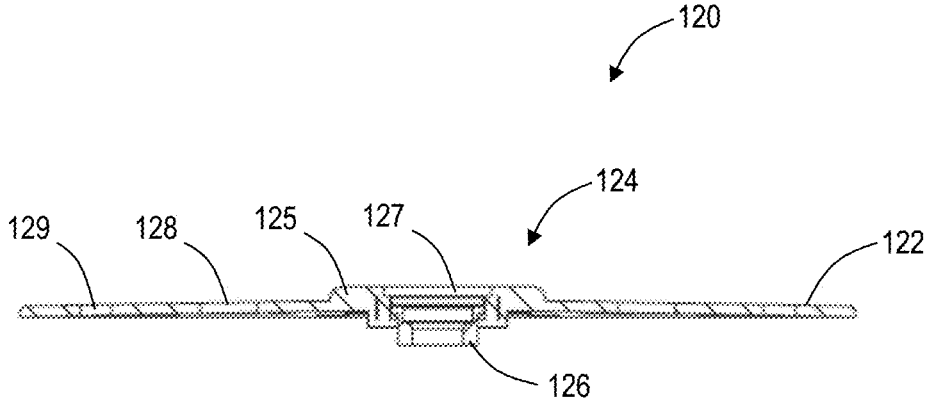
FIG. 8 is a cross-sectional view of the backerplate of FIGS. 5-7 taken along the line VIII-VIII of FIG. 6.

The backing assembly 170 includes a backerplate 120. FIG. 5 is a perspective view of the backerplate 120 of the portable drywall sander hub assembly 100 of FIG. 1. FIG. 6 is an alternate perspective view of the backerplate 120 of FIG. 5. FIG. 7 is a top perspective view of the backerplate 120 of FIGS. 5 and 6. FIG. 8 is a cross-sectional view of the backerplate 120 of FIGS. 5-7 taken along the line VIII-VIII of FIG. 6. Referring to FIGS. 1, and 5-8, the backerplate 120 is adapted to be received in the counterbore 114. The backerplate includes a mounting portion 124 and a backerplate body 122. The mounting portion 124 forms a threaded bore 127 adapted to couple to the sander hub 110. In embodiments, the threaded bore 127 is adapted to couple to the fastener 116 of the sander hub 110.

In embodiments, the mounting portion 124 includes a rear protrusion 126 that protrudes in an axial direction of the mounting portion 124 and protrudes relative to the backerplate body 122 in the axial direction, in a direction towards the sander hub 110. The rear protrusion 126 is adapted to ensure that the backerplate body 122 is offset from an opposing axially facing surface of the sander hub 110, such as the inner surface 115.

In some embodiments, the mounting portion 124 also includes a front protrusion 125 that protrudes in an axial direction of the mounting portion 124 and protrudes relative to the backerplate body 122 in the axial direction, opposite the direction of the rear protrusion 126 and in a direction opposite the sander hub 110.

The backerplate body 122 is adapted to be offset from the inner surface 115 of the sander hub 110 while the mounting portion 124 is coupled to the fastener 116. The backerplate body 122 is connected to the mounting portion 124. The backerplate body 122 forms backerplate apertures 128, 129 therein. The backerplate apertures 128, 129 are positioned radially between an outer circumference 123 of the backerplate body 122 and the mounting portion 124. The backerplate apertures 128, 129 are adapted for dust to pass therethrough and into the cavity 117, formed in the counterbore 114 between the sander hub 112 and the backerplate body 122, during operation of a drywall sander.

In embodiments, the backerplate body 122 includes an annular disc shape and the backerplate apertures 128, 129 are symmetrically positioned about the annular disc shape. In some of these embodiments, the backerplate apertures 128, 129 include a first set of apertures 128 symmetrically positioned at a first radial offset about an axis of the annular disc shape and a second set of apertures 129 symmetrically positioned at a second radial offset about the axis of the annular disc shape. The second radial offset is different than the first radial offset. Further, in some of these embodiments, the first set of apertures 128 includes a size and a spacing that is different than the second set of apertures 129. In the embodiment illustrated, the first set of apertures 128 is positioned radially inward from the second set of apertures 129 and the first set of apertures 128 include a diameter that is larger than the second set of apertures 129. However, other sizes, spacing, and orientation of the backerplate apertures 128, 129 are also contemplated.

While the backerplate apertures 128, 129 are shown as circular holes in the embodiment shown, in embodiments, the backerplate apertures 128, 129 include openings, holes, straight slots, angled, slots, gaps, patterns formed therefrom, combinations thereof, and the like.

Figure 9:
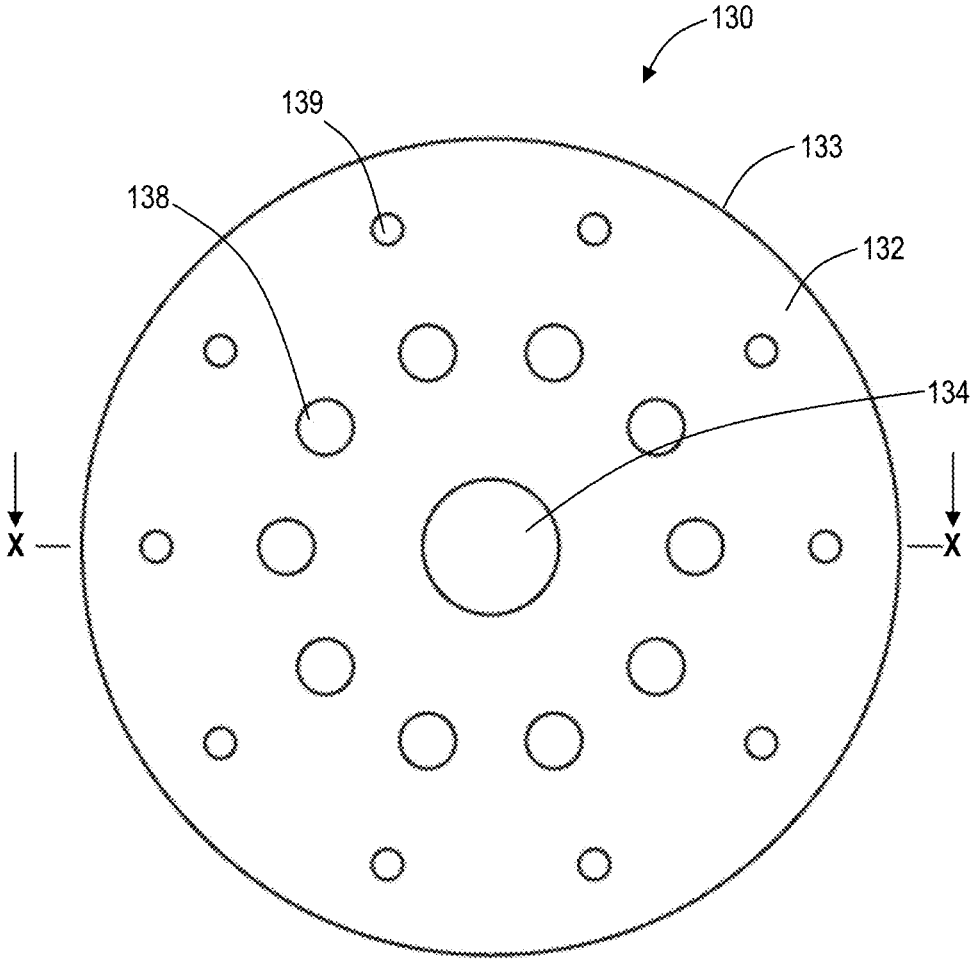
FIG. 9 is a perspective view of the intermediate plate of the portable drywall sander hub assembly of FIG. 1.
Figure 10:
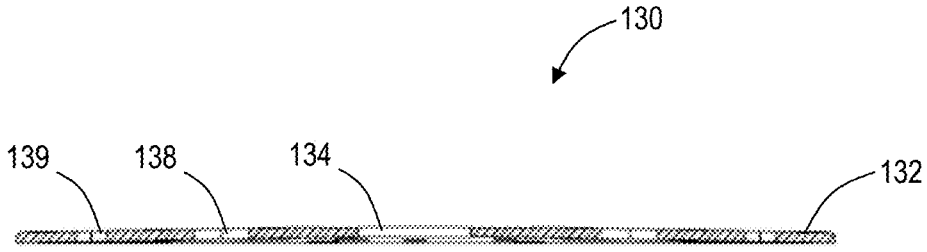
FIG. 10 is a cross-sectional view of the intermediate plate of FIG. 9 taken along the line X-X of FIG. 9.

Referring to FIG. 1, in embodiments, the backing assembly 170 also includes an intermediate plate 130. FIG. 9 is a perspective view of the intermediate plate 130 of the portable drywall sander hub assembly 100 of FIG. 1. FIG. 10 is a cross-sectional view of the intermediate plate 130 of FIG. 9 taken along the line X-X of FIG. 9. Referring to FIGS. 1, 9, and 10, the intermediate plate 130 is joined to the backerplate 120. The intermediate plate 130 includes an intermediate plate body 132 that forms intermediate plate apertures 138, 139 therein. The intermediate plate apertures 138, 139 are sized and spaced to match and align with the backerplate apertures 128, 129.

In some embodiments, the intermediate plate body 132 includes an annular disc shape and the intermediate plate apertures 138, 139 are symmetrically positioned about the annular disc shape. In some of these embodiments, the intermediate plate apertures 138, 139 include a first set of apertures 138 symmetrically positioned at a first radial offset about an axis of the annular disc shape and a second set of apertures 139 symmetrically positioned at a second radial offset about the axis of the annular disc shape. The second radial offset is different than the first radial offset. Further, in some of these embodiments, the first set of apertures 138 includes a size and a spacing that is different than the second set of apertures 139. While the intermediate plate apertures 138, 139 are shown as circular holes in the embodiment shown, in embodiments, the intermediate plate apertures 138, 139 include openings, holes, straight slots, angled, slots, gaps, patterns formed therefrom, combinations thereof, and the like, which match those of the backerplate apertures 128, 129.

In embodiments, the intermediate plate body 132 forms an intermediate plate bore 134 that is adapted to receive the front protrusion 125. The front protrusion 125 is adapted to guide the intermediate plate 130 into axial alignment with the backerplate 120.

In embodiments, the intermediate plate body 132 is adapted to receive and hold the sanding medium relative to the backing assembly 170.

Referring again to FIG. 1, the backing assembly 170 includes a backing fastener 140, 150 that is adapted to join and couple the intermediate plate 130 to the backerplate 120. In the embodiment illustrated, the backing fastener 140, 150 is a hook and loop fastener and includes a backerplate fastener 140 and an intermediate plate fastener 150. The backerplate fastener 140 and the intermediate plate fastener 150 include fastening portions 145, 155, which include fastening features, such as hooks and loops.

In some embodiments, each of the backerplate fastener 140 and the intermediate plate fastener 150 includes fastener apertures 148, 149, 158, 159 that are sized and spaced to match and align with the backerplate apertures 128, 129 and the intermediate plate apertures 138, 139. The size, positioning, and shapes of the fastener apertures 148, 149, 158, 159 include any of the size, positioning, and shapes of the backerplate apertures 128, 129 and the intermediate plate apertures 138, 139 disclosed herein.

In embodiments, each the backerplate fastener 140 and the intermediate plate fastener 150 forms a fastener bore 144, 154 that is adapted to receive the front protrusion 125. In embodiments, the front protrusion 125 is adapted to act as a guide when securing the backerplate fastener 140 to the backerplate body 122. The backerplate fastener 140 and the intermediate plate fastener 150 are secured respectively to the backerplate body 122 and the intermediate plate body 132, respectively, such as by an adhesive.

Figure 11:
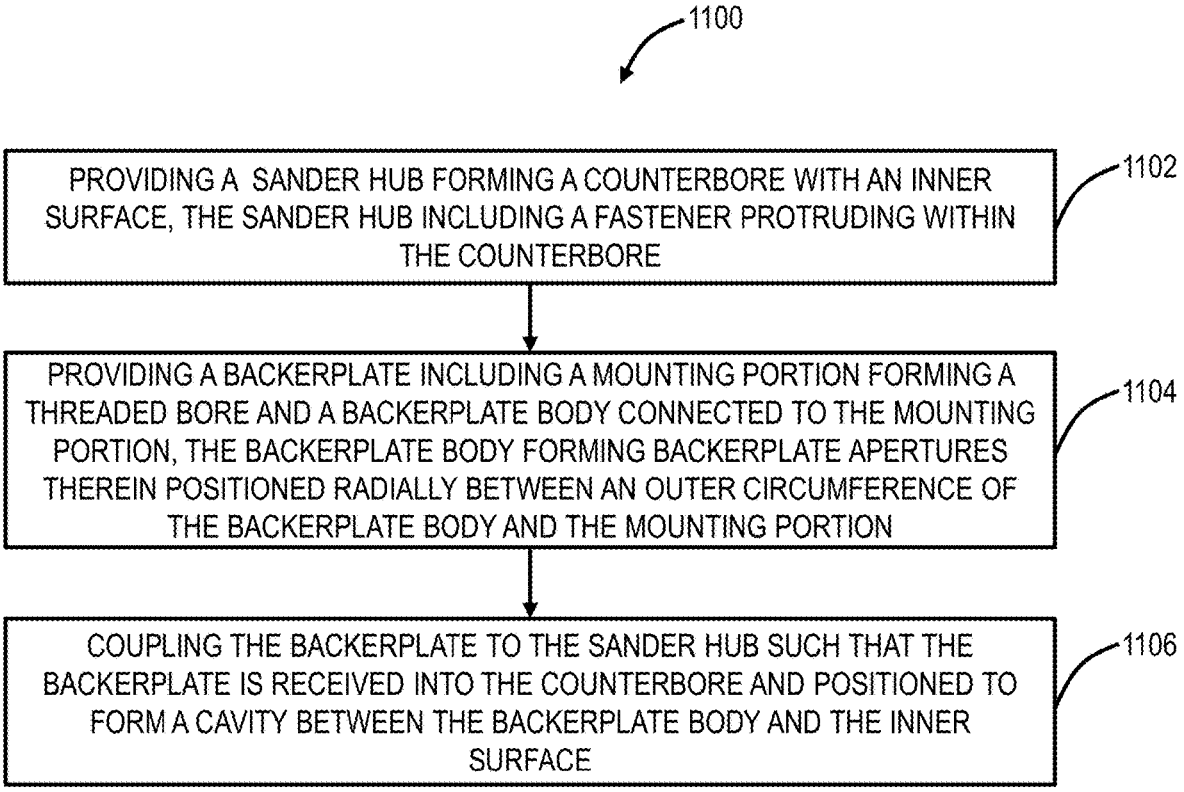
FIG. 11 is a flowchart of a method for assembling the portable drywall sander hub assembly of FIG. 1.
Figure 12:
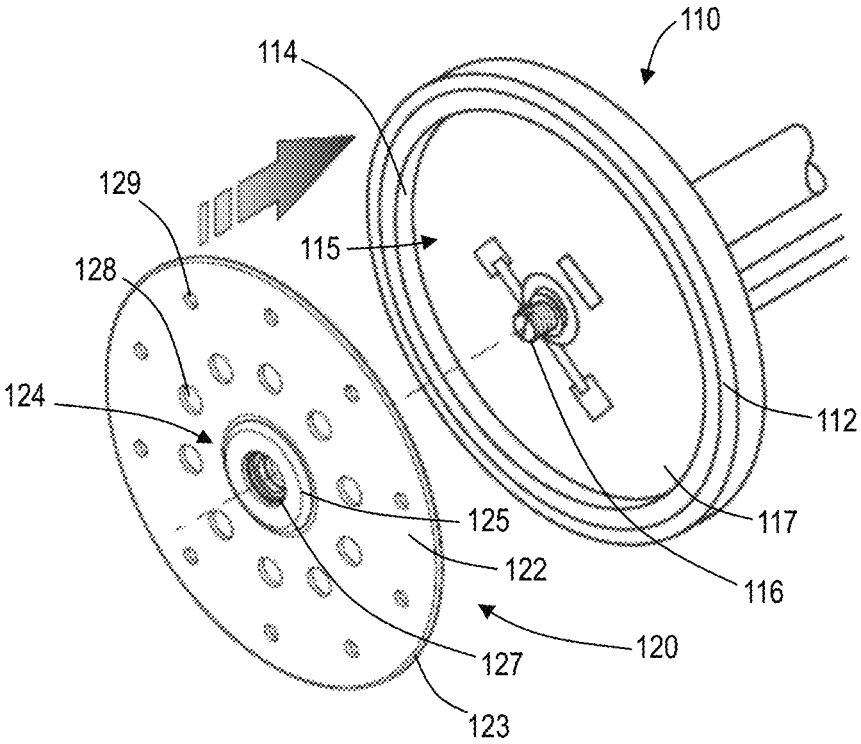
FIG. 12 is a perspective view illustrating the assembly of the sander hub and the backerplate of the portable drywall sander hub assembly of FIG. 1.
Figure 13:
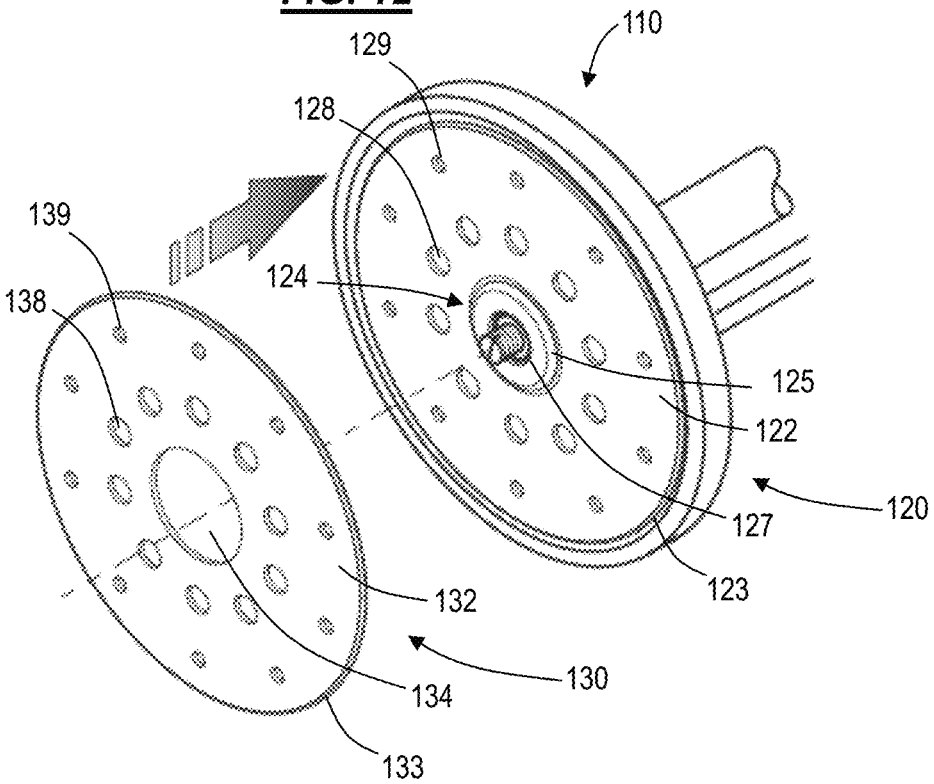
FIG. 13 is a is a perspective view illustrating the assembly of the intermediate plate to the assembled sander hub and the backerplate of the portable drywall sander hub assembly of FIG. 1.

FIG. 11 is a flowchart of a method 1100 for assembling the portable drywall sander hub assembly 100 of FIG. 1. FIG. 12 is a perspective view illustrating the assembly of the sander hub 110 and the backerplate 120 of the portable drywall sander hub assembly 100 of FIG. 1. FIG. 13 is a is a perspective view illustrating the assembly of the intermediate plate 130 to the assembled sander hub 110 and the backerplate 20 of the portable drywall sander hub assembly 100 of FIG. 1.

The method 1100 includes providing a sander hub 110 forming a counterbore 114 with an inner surface 115, the sander hub 110 including a fastener 116 protruding within the counterbore 114, at step 1102. The method 1100 also includes providing a backerplate 120 including a mounting portion 124 forming a threaded bore 127 and a backerplate body 122 connected to the mounting portion 124, the backerplate body forming backerplate apertures 128, 129 therein positioned radially between an outer circumference 123 of the backerplate body 122 and the mounting portion 124, at step 1104. As can be seen in FIG. 12, the method 1100 further includes coupling the backerplate 120 to the sander hub 110 such that the backerplate 120 is received into the counterbore 114 and positioned to form a cavity 117 between the backerplate body 122 and the inner surface 115 at step 1106. In embodiments, the width of the cavity 117 is at least partially controlled by a rear protrusion 126 of the mounting portion 124.

Referring to FIG. 13, in some embodiments, the method 1100 yet further includes fastening an intermediate plate 130, including an intermediate plate body 132 forming intermediate plate apertures 138, 139 therein, to the backerplate 120 such that the intermediate plate apertures 138, 139 align with the backerplate apertures 128, 129. In embodiments, the intermediate plate 130 is fastened to the backerplate 120 via a hook and loop fastener. In some embodiments, the hook and loop fastener includes a backerplate fastener 140 and an intermediate plate fastener 150.

In embodiments, the intermediate plate 130 and the backerplate 120 are aligned via a front protrusion 125 of the mounting portion 124 that extends axially outward relative to the backerplate body 122 and via an intermediate plate bore 134 that receives the front protrusion 125.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. A backing assembly for a portable drywall sander hub assembly, comprising a backerplate including a mounting portion forming a threaded bore adapted to couple the backerplate to a fastener of a sander hub, the fastener of the sander hub protruding within a counterbore of the sander hub, and a backerplate body connected to the mounting portion and forming a plurality of backerplate apertures therein positioned radially between an outer circumference of the backerplate body and the mounting portion, the plurality of apertures being adapted for dust to pass therethrough and into a cavity, formed into the counterbore between the sander hub and the backplate body, during operation of a drywall sander with the backerplate mounted thereto; and an intermediate plate joined to the backerplate, the intermediate plate including an intermediate plate body forming a plurality of intermediate plate apertures therein, the plurality of intermediate plate apertures being sized and spaced to match and align with the plurality of backerplate apertures, wherein the backerplate and the intermediate plate are joined by fasteners, the fasteners including a first fastener attached to the backerplate and a second fastener attached to the intermediate plate, and wherein each of the first fastener and the second fastener includes a plurality of fastener apertures sized and spaced to match and align with the plurality of backerplate apertures and the plurality of intermediate plate apertures, wherein the mounting portion includes a front protrusion that protrudes in an axial direction of the mounting portion and protrudes relative to the backerplate body in the axial direction towards the intermediate plate, wherein the front protrusion is adapted to guide the intermediate plate into axial alignment with the backerplate, and wherein the intermediate plate forms an intermediate plate bore adapted to receive the front protrusion, wherein the mounting portion includes a rear protrusion that protrudes in an axial direction of the mounting portion and protrudes relative to the backerplate body in the axial direction opposite the intermediate plate, the rear protrusion adapted to ensure that the backerplate body is offset from an opposing axially facing surface of the sander hub, and wherein the plurality of backerplate apertures, the plurality of intermediate plate apertures, and the plurality of fastener apertures are adapted for dust to pass therethrough during operation of a drywall sander with the backerplate and intermediate plate mounted thereto.

2. The backing assembly of claim 1, wherein the backerplate body and the intermediate plate each comprise an annular disc shape, and wherein the plurality of backerplate apertures and the plurality of intermediate plate apertures are symmetrically positioned about the respective annular disc shape.

3. The backing assembly of claim 2, wherein the plurality of backerplate apertures and the plurality of intermediate plate apertures each includes a first set of apertures symmetrically positioned at a first radial offset about an axis of the respective annular disc shape and a second set of apertures symmetrically positioned at a second radial offset about the axis of the respective annular disc shape, the second radial offset being different than the first radial offset.

4. The backing assembly of claim 3, wherein the first set of apertures include a size that is different than the second set of apertures for each of the plurality of backerplate apertures and the plurality of intermediate plate apertures.

5. A portable drywall sander hub assembly, comprising:

a sander hub forming a counterbore with an inner surface, the sander hub including a fastener protruding within the counterbore;

a backerplate adapted to be received in the counterbore, the backerplate including a mounting portion forming a threaded bore adapted to couple to the fastener of the sander hub, and a backerplate body adapted to be offset from the inner surface while the mounting portion is coupled to the fastener, the backerplate body being connected to the mounting portion and forming a plurality of apertures therein positioned radially between an outer circumference of the backerplate body and the mounting portion, the plurality of apertures being adapted for dust to pass therethrough and into a cavity, formed in the counterbore between the sander hub and the backerplate body, during operation of a drywall sander with the backerplate mounted thereto; and an intermediate plate joined to the backerplate, the intermediate plate including an intermediate plate body forming a plurality of intermediate plate apertures therein, the plurality of intermediate plate apertures being sized and spaced to match and align with the plurality of backerplate apertures, wherein the backerplate and the intermediate plate are joined by a hook and loop fastener, the hook and loop fastener including a first fastener attached to the backerplate and a second fastener attached to the intermediate plate, and wherein each of the first fastener and the second fastener including a plurality of fastener apertures sized and spaced to match and align with the plurality of backerplate apertures and the plurality of intermediate plate apertures, wherein the mounting portion includes a front protrusion that protrudes in an axial direction of the mounting portion and protrudes relative to the backerplate body in the axial direction towards the intermediate plate, wherein the front protrusion is adapted to guide the intermediate plate into axial alignment with the backerplate, and wherein the intermediate plate includes an intermediate plate bore adapted to receive the front protrusion, wherein the mounting portion includes a rear protrusion that protrudes in an axial direction of the mounting portion and protrudes relative to the backerplate body in the axial direction opposite the intermediate plate, the rear protrusion adapted to ensure that the backerplate body is offset from an opposing axially facing surface of the sander hub.

6. The portable drywall sander hub assembly of claim 5, wherein the backerplate body comprises an annular disc shape and the plurality of apertures are symmetrically positioned about the annular disc shape.

7. The portable drywall sander hub assembly of claim 6, wherein the plurality of apertures includes a first set of apertures symmetrically positioned at a first radial offset about an axis of the annular disc shape and a second set of apertures symmetrically positioned at a second radial offset about the axis of the annular disc shape, the second radial offset being different than the first radial offset.

8. The portable drywall sander hub assembly of claim 7, wherein the first set of apertures include a size that is different than the second set of apertures.

* * * * *